United States Patent [19]

Josias et al.

[11] Patent Number: 4,747,345

[45] Date of Patent: May 31, 1988

[54] FOIL STAMPING BED AND CYLINDER PRESS

[75] Inventors: Basil W. Josias; Keith T. T. Josias, both of Auckland, New Zealand

[73] Assignee: North Shore Foil Stamping Specialists, Ltd., Auckland, New Zealand

[21] Appl. No.: 893,262

[22] Filed: Aug. 5, 1986

[30] Foreign Application Priority Data

Aug. 7, 1985 [NZ] New Zealand ..... 213037

[51] Int. Cl.[4] ..... B41F 3/18; B41F 19/02

[52] U.S. Cl. ..... 101/27; 101/281

[58] Field of Search ..... 101/27, 250, 281

[56] References Cited

U.S. PATENT DOCUMENTS 1,152,587 9/1915 Wright ..... 101/281 X 4,627,343 12/1986 Liepelt ..... 101/281 X

FOREIGN PATENT DOCUMENTS 1279225 6/1972 United Kingdom .

*Primary Examiner*—Clifford D. Crowder

*Attorney, Agent, or Firm*—Wenderoth, Lind & Ponack

[57] ABSTRACT

A foil stamping device for printing material such as gold foil onto paper, cardboard or similar materials having a moving bed to hold the paper cardboard or the like. Mounting means to hold a quantity of foil, the mounting means being on and moving with the bed. A pressure member applies pressure to the foil to effect printing.

3 Claims, 3 Drawing Sheets

FOIL STAMPING BED AND CYLINDER PRESS

BACKGROUND OF THE INVENTION

1. Field of the Invention

This invention relates to foil stamping devices and has been devised particularly though not solely for use in stamping foil such as gold foil or silver foil onto sheet material such as paper, card or the like.

2. Description of the Prior Art

When stamping gold or silver foil at the present time, disadvantages exist in that often the area of foil that can be stamped onto a receiving surface such as a paper sheet is limited by the area of a moving platen carrying the indicia to be stamped. There is also a tendency for foil parts to be left behind as the moving platen withdraws.

SUMMARY OF THE INVENTION

It is an object of the present invention to provide a foil stamping device which will go at least some distance towards overcoming the foregoing disadvantages in a simple yet effective manner or which will at least provide the public with a useful choice.

Accordingly the invention comprises in a foil stamping device which includes a moving bed, mounting means on the bed to hold a quantity of foil or the like for positioning thereof over the bed, and a pressure member which is able to apply pressure to the bed as the bed moves in a reciprocal manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION OF THE PREFERRED EMBODIMENT

Figure 1:
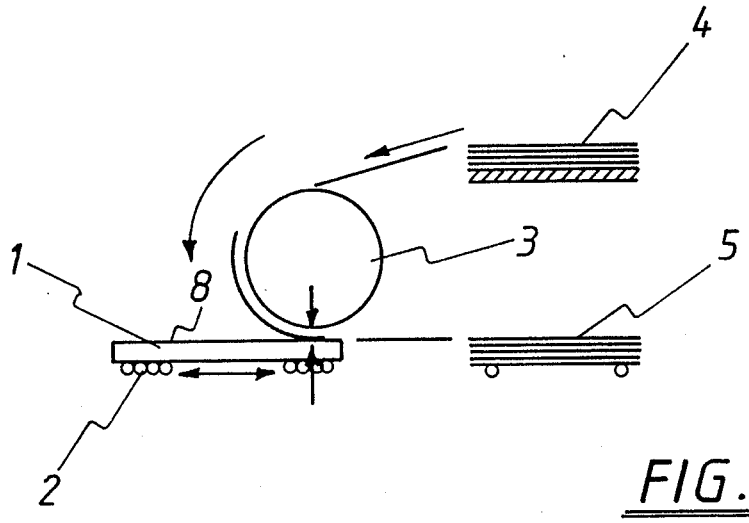
FIG. 1 is a diagrammatic representation of a foil stamping device according to one preferred form of the invention.
Figure 2:
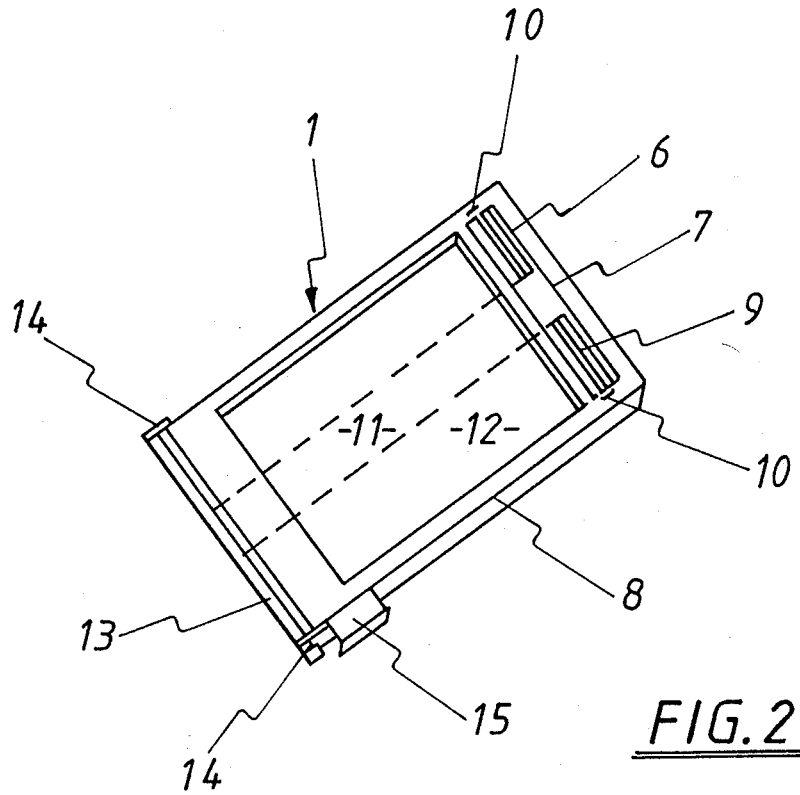
FIG. 2 is a diagrammatic perspective view of a moving bed for use in a foil stamping device according to one preferred form of the invention.
Figure 3:
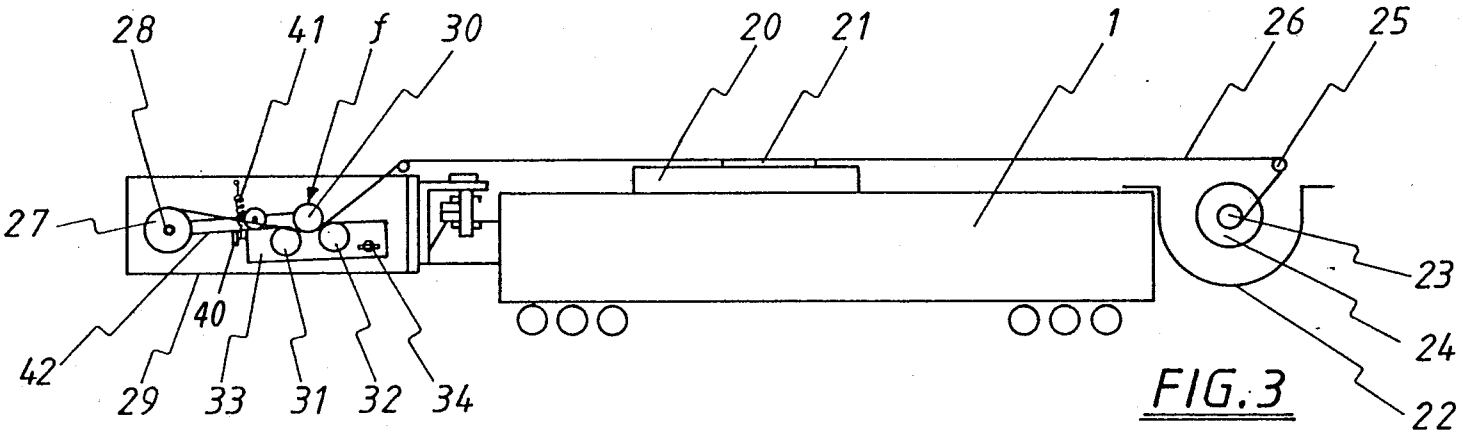
FIG. 3 is a side cross section of a moving bed for use in a foil stamping device according to one preferred form of the invention.

Referring to the drawings, a foil stamping device is provided which comprises a moving bed 1 which may move in a reciprocal manner for example on rollers such as rollers 2 provided on a supporting frame (not shown). Pressure means are provided to apply pressure to the moving bed 1 during selected passes for example passes in a forward direction of the moving bed and the pressure means may comprise a cylinder drum or roller 3.

Means are provided to guide sheet material such as paper, card or the like from a feed position 4 about the drum or the like 3 to a delivery position 5. A Heidelberg Cylinder printing machine (not shown) provides these functions.

The moving bed 1 is modified by providing mounting means on the moving bed 1 to hold a quantity of foil or the like and to this end a depression or recess 6 may be provided into which a roll of foil 7 is positioned preferably so that the foil is positioned substantially below the level of the top surface 8 of the moving bed 1. Thus, the foil may be mounted on a shaft 9 having opposite ends thereof positioned in notches or cutouts 10 at each side of the recess 6. The foil or the like 7 is extended at 11 over a recessed area 12 into which type or the like is positioned. It is desirable that a receiving means be provided for the foil 7 and this may comprise a rod or shaft 13 mounted at opposite ends thereof in supports 14 at each side of the bed 1 thereof so as to collect the foil when it is spent.

Between passes of the moving bed, the foil is moved a selected distance so as to present fresh foil for the next pass of the moving bed below the cylinder or drum 3. To this end an indexing device indicated at 15 is provided so that the shaft 13 is rotated sufficiently to move the foil the desired distance forwardly between such passes. The indexing device could include for example a rack and pinion or an electronic motor control mechanism.

In a particular construction the bed 1 has mounting means 20 which may be a head for type face or the like 21 substantially in the known manner. A tray 22 is mounted onto one end of the bed 1 and a spindle 23 is provided which mounts in use a supply roll of foil 24. A bar or the like 25 is provided for guiding a foil sheet 26 over the bed 1 as the foil is fed from the roll 24.

At the other end of the bed 1 is provided feed means for withdrawing the foil from the supply roll 24 and also, a takeup roll 27 is provided to collect the used foil 26. The roll 27 is mounted on a spindle or axle 28.

The spindle 28 is mounted in an open topped housing 29 mounted on bed 1. Within the housing 29 and mounted therein is a driven roller 30 and therebelow is a pair of idler rolls 31 and 32 which are movable towards and away from the driven roller 30. This may be achieved by mounting the rollers 31 and 32 on a pair of levers 33 pivotally mounted to the housing 29 at 34. The levers 33 are biased so that the rollers 31 and 32 are biased towards the roller 30 which is positioned between and to one side of the rollers 31 and 32. A cam 40 in the housing 29 is rotated to push the levers 33 to move the rollers 31 and 32 away from the roller 30, the rollers 33 being normally biased towards the roller 30 by springs 41 extending between the levers 33 and the housing 29. The spindle 28 and the roller 30 are coupled by means such as, for example, by a belt 42, so that the spindle 28 and the roller 30 rotate at the same time.

Figure 6:
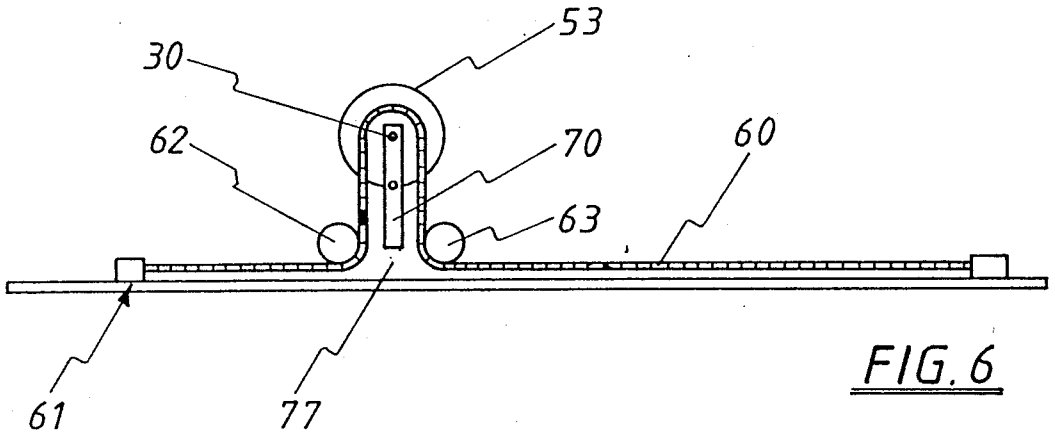
FIG. 6 is a side elevation of part of a drive mechanism for use in the invention.

The roller 30 has an axle 56 at one end passing through a bearing 51 inside a wall 52 of the housing 29 and a clutch mechanism 53 is connected to the axle 56 of the roller 30. The clutch mechanism 53 includes a plate 54 mounted on the axle 56 which rotates with the roller 30 and another plate 55 which is mounted so as to be freely rotatable on the axle 56 extending from roller 30. The plate 55 is rotated, for example, by a chain 60 fixed at each end thereof to a non-moving part such as a frame 61 (as shown in FIG. 6) on which the bed 1 moves. The chain 60 extends under a pair of idler sprockets 62 and 63 and over a sprocket 64 which is disposed therebetween, the sprocket 64 being coupled to the plate 55 for rotation therewith. A housing mechanism 66 for adjusting the tension of the chain 60 may be provided at at least one end of chain 60.

Figure 4:
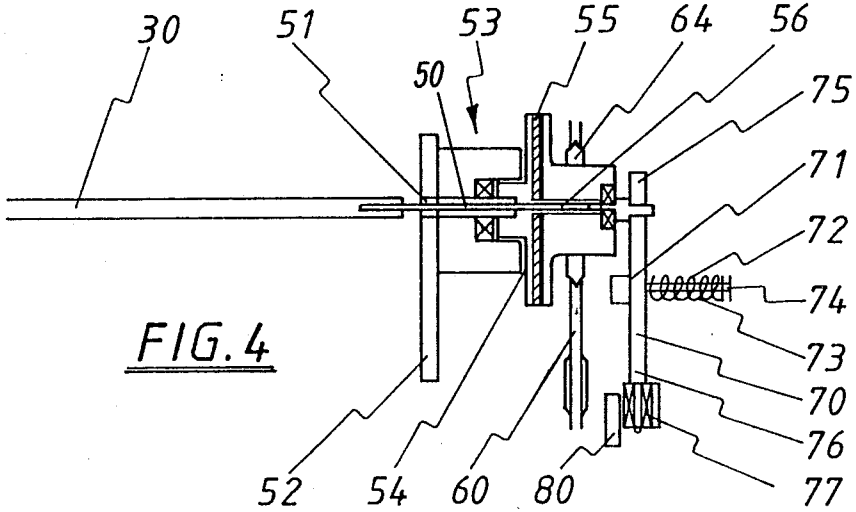
FIG. 4 is a cross section of a clutch useable in an indexing device for use with a preferred form of the invention.
Figure 5:
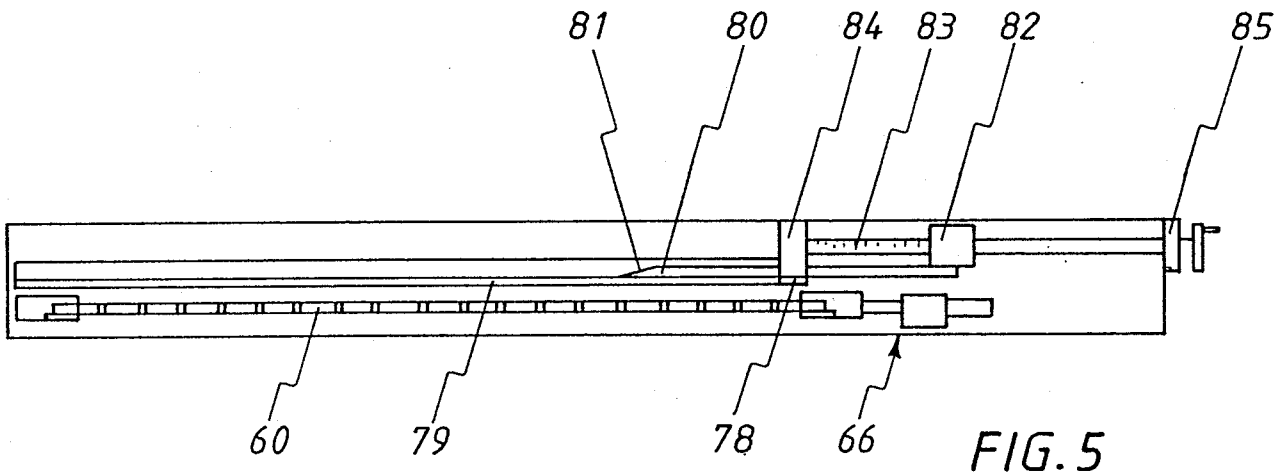
FIG. 5 is a plan view of part of the indexing device of FIG. 4.

Means are provided for moving the plate 55 towards the plate 54 and, as shown in FIG. 4, these means may comprise a lever 70 which has a fulcrum 71, the fulcrum 71 being mounted to the housing 29, for example. The fulcrum 71 may have a rod 72 extending therefrom through an aperture in the lever 70 so that the lever 70 is urged against the fulcrum 71 for example by a spring 73 between the lever 70 and an enlarged head 74 on the rod 72.

One end 75 of the lever 70 rotatably supports the plate 55 and the other end 76 of the lever 70 carries a roller 77. Towards one end 78 of a rail 79, associated with the frame 61 on which the bed 1 moves, is a bar 80 which has a tapered end at 81. The bar 80 is fixed to a block 82 which is threadedly engaged with a threaded shaft 83. A further block 84 assists in aligning the bar 80. By rotating the shaft 83 in a fixed block 85, the position of the bar 80 may be varied in a longitudinal direction. A variety of lengths of the bar 80 may also be provided. The adjusting mechanism 66 may be similarly arranged. Thus, when roller 77 moves up the face of the tapered end 81 onto the bar 80, the effect is to move the plate 55 into contact with the plate 54 to cause the roller 30 to rotate. When the roller 77 is moved in the opposite direction, the roller 77 becomes free of the bar 80 and rotation of the roller 30 and also the spindle 28 ceases.

The use of the invention is as follows.

In use, card, paper or the like is positioned at 4 and moved about the drum 3. Co-ordinated with this movement is a movement of the moving bed 1 forward and back below the drum 3 so that a desired print area is co-ordinated in movement with the supply of paper at 4. As the drum bears on the paper and the type, the foil therebetween is transferred from its backing to the paper or the like which then then passes to the delivery position 5. The moving bed 1 then moves outwardly and the foil is moved so that a fresh foil is positioned above the relevant type face for the next pass of the device. The indexing device described above causes the foil to move in between printing passes.

Thus it can be seen that a foil printing device or the like is provided which has the advantage that at least in the preferred form of the invention substantially the full foil size can be used for the printing operation. The present invention allows an area to be printed which is large in both length and width which is advantageous. In particular a large sheet size can be accomodated without hard feeding even though only a small area of the sheet is to be printed. Also printing is effected substantially in one strike and there is little tendency for the foil to be left which can happen with the presently known moving platen constructions.

What we claim is:

1. A foil stamping device comprising a moving bed movable in a reciprocal manner with respect to and mounted on a frame, mounting means on said bed for holding a quantity of foil and guiding said foil to a position over said bed, pressure member means mounted on said frame for applying pressure to said bed at at least said position as said bed moves in said reciprocal manner, a roller engageable with said foil and indexing means for rotating said roller to move said foil, said indexing means comprising an elongated mechanical linkage fixed in the proximity of its ends to said frame and driving between its ends a clutch, said clutch driving said roller, and means to open said clutch on a pass of said moving bed inwardly under said pressure member means and close said clutch on a pass of said moving bed outwardly from under said pressure member means so that said mechanical linkage causes said roller to rotate and move said foil.

2. A foil stamping device as claimed in claim 1, wherein said pressure member means comprises a drum roller beneath which said bed passes.

3. A foil stamping device as claimed in claim 1, further including receiving means for receiving used foil.

* * * * *